US005133531A

United States Patent [19]

Grashoff et al.

[11] Patent Number: 5,133,531

[45] Date of Patent: Jul. 28, 1992

[54] RAILROAD CAR JACK

[75] Inventors: William G. Grashoff, La Grange Park, Ill.; Charles Spence, Oak Creek, Wis.

[73] Assignee: TTX Company, Chicago, Ill.

[21] Appl. No.: 716,303

[22] Filed: Jun. 17, 1991

[51] Int. Cl.[5] ..... B66F 7/12

[52] U.S. Cl. ..... 254/89 H

[58] Field of Search ..... 187/8.5, 8.57, 8.59, 187/9 R; 254/89 H, 89 R, 90, 91, 2 C

[56] References Cited

U.S. PATENT DOCUMENTS

| | | | |
|---|---|---|---|
| 2,686,038 | 8/1954 | Dutzman | 254/91 |
| 2,724,572 | 11/1955 | Weinberg | 254/89 H |
| 2,958,508 | 11/1960 | Martinez | 254/89 H |
| 3,638,911 | 2/1972 | Mize et al. | 254/89 H |
| 4,068,823 | 1/1978 | Belanger | 254/89 H |
| 4,793,593 | 12/1988 | Pittman | 254/89 H |
| 4,805,875 | 2/1989 | Jackson et al. | 254/90 |
| 4,856,618 | 8/1989 | Isogai | 254/89 H |

*Primary Examiner*—Robert C. Watson

*Attorney, Agent, or Firm*—Kinzer, Plyer, Dorn, McEachran & Jambor

[57] ABSTRACT

A jack for railroad well cars has a frame comprising a central section which fits between the rails and the underside of the car frame. The central section spans the rails and extends somewhat beyond the sides of the car frame. The central frame section connects to a fixed, upright frame section at one end and a pivot section at the other end. The pivot section is movable between a horizontal setup position and a vertical operating position. A lifting beam is mounted on the frame and extends transversely to the car frame. Hydraulic actuators connected between the ends of the lifting beam and the frame are adapted to move the lifting beam between lowered and raised positions. A ratchet and pawl are provided on the upright and pivot frame sections to prevent unwanted lowering of the lifting beam.

18 Claims, 3 Drawing Sheets 142
144
146
148
26
20
30B
92B
32B
34
94
32A
92A
30A
28
56
58
62
52B
60B
128B
138
132B
130B
124B
140
54B
126B
22
68
70
64
66
3
5
4
72B
76B
74
24
88
90
82
84B
86
50
48
78B
46
44
42
51B
40B

RAILROAD CAR JACK

BACKGROUND OF THE INVENTION

Maintenance of railroad cars sometimes requires lifting or elevating the car frame to increase the clearance between the frame and the rails. Such lifting may be required, for example, to replace or repair complete trucks or wheel and axle sets.

A jack assembly for railroad cars is shown in U.S. Pat. No. 4,805,875. That patent discusses the requirements of a railroad car jack and the general nature of the prior art and problems therewith. The jack of the '875 patent has a compact power lift cylinder, in the form of a multiple-sleeve power cylinder which is engageable with the center sill or beam of the car frame.

While the jack of the '875 patent is suitable for cars having a center beam or sill, it is not adapted for use with well cars. Well cars have two side beams or sills which define a well for carrying containers. The side sills are connected at their ends to end sills which in turn are supported on trucks. The well is defined between the trucks. To permit carrying stacked containers, the well has a low clearance above the tracks. The clearance under the bottom of the sills in a well car is approximately six inches.

Well cars may be either standalone cars which have a single platform or section with trucks and couplers at each end. Or the well car may have a plurality of platforms or sections joined at shared, articulated trucks with couplers only at the outer ends. In either configuration, the structure of a well car presents lifting problems not addressed by the jack of the '875 patent.

SUMMARY OF THE INVENTION

The present invention concerns a jack for railroad cars and is particularly concerned with a jack which can lift either well cars or center beam type cars.

A primary object of the invention is a jack of the type described which is small and compact, allowing it to be used in close quarters and has the ability to lift any type of rail car.

Another object of the invention is a jack which can lift vertically about 30 inches.

Another object of the invention is a jack for railroad cars which has a low profile or silhouette, allowing it to fit under cars having a clearance of about six inches.

Still another object of the invention is a jack for railroad cars which can lift articulated cars without unhooking the car platforms, with the lift being sufficient to permit changeout of wheels and trucks.

These and other objects are realized by a jack having an elongated, central frame section which spans the rails and rests on top thereof when the jack is placed underneath a car. A lifting beam is mounted on the frame and extends transversely to the car frame when the jack is in position under a car. The lifting beam is movable between a lowered position wherein it fits underneath the car, and a raised position wherein the beam holds the car frame above the car's normal position relative to the rails.

A first hydraulic actuator has a rod pivotally connected to the frame central section about a first horizontal axis. The actuator also has a cylinder pivotally connected to the lifting beam about a second horizontal axis near one end of the lifting beam. When the lifting beam is in its lowered position, the first and second axis coincide, thereby permitting the hydraulic actuator to pivot between a horizontal setup position and a vertical operating position.

A second hydraulic actuator at the other end of the central frame section is connected to the lifting beam. The first and second hydraulic actuators are adapted to move the lifting beam between its lowered and raised positions.

DETAILED DESCRIPTION OF THE INVENTION

Figure 1:
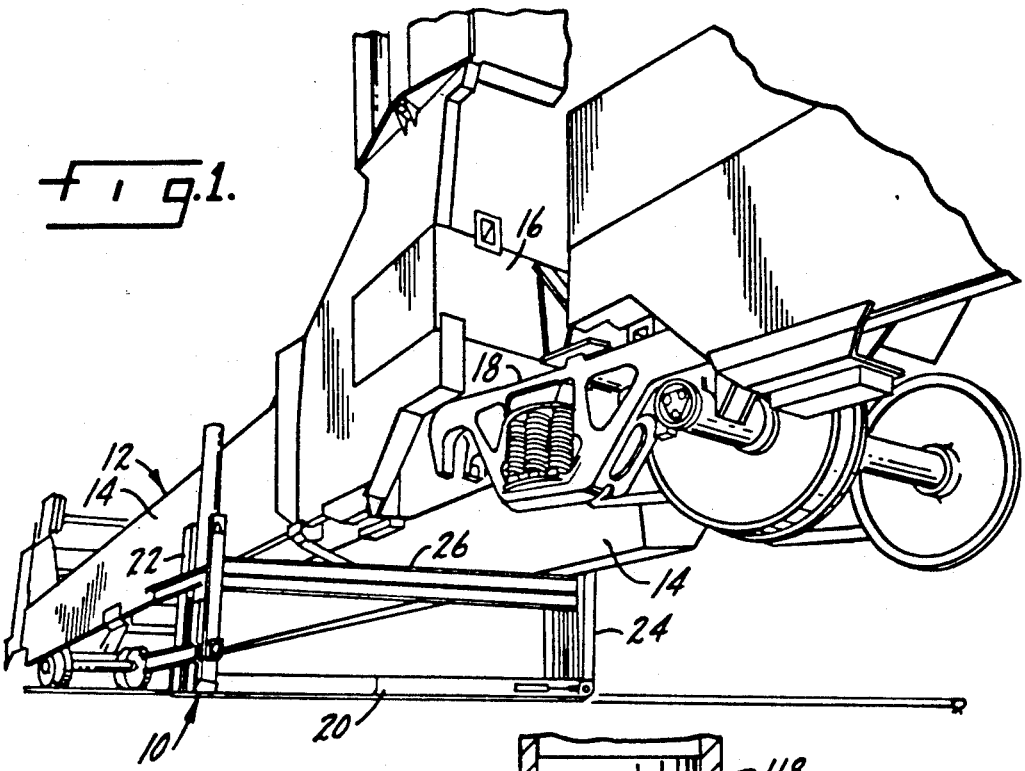
FIG. 1 is a perspective view of the jack showing it in operation, lifting a platform of an articulated well car.

FIG. 1 shows the jack 10 of the present invention lifting a platform 12 of an articulated well car. The platform or section 12 has side sills 14 connected to end sills 16. A portion of a shared articulated truck 18 is shown with one wheel set removed.

The jack has a frame including a central section 20, a fixed, upright section 22 at one end of the central section and a pivot section 24 at the other end of the central section. As explained more fully below, the pivot section is pivotable between a horizontal, setup position and the vertical, operating position shown in FIG. 1. A lifting beam 26 extends between the upright and pivot sections of the frame. It is movable by a pair of hydraulic actuators between a lowered position wherein the lifting beam is in contact with the frame central section 20, and a raised position wherein the lifting beam is in contact with the car frame to lift it above its normal position relative to the track rails. The lifting beam is shown in FIG. 1 in a raised position.

Details of the parts shown generally in FIG. 1 are illustrated in FIGS. 2-5. For reference purposes throughout the following description, the jack will be considered to have a left and right side as seen from the fixed, upright end of the frame. This is the viewpoint of an operator inserting the jack into an operating position under a car. Also, elements that have left and right counterparts have lettered reference numerals (e.g., 30A, 30B) to refer to the parts individually while the unlettered numeral (e.g., 30) refers to the parts collectively.

Looking first at the central section 20 of the frame, a steel base plate 28 extends the length of the central section. The plate has a cutout 29 at each end providing clearance for the piston rod. The base plate 28 is long enough to permit the central frame section to span the rails and rest on the tops thereof when the jack is in position for lifting a car. For reference purposes only, the base plate is about 12 feet long and about 20 inches wide.

Figure 5:
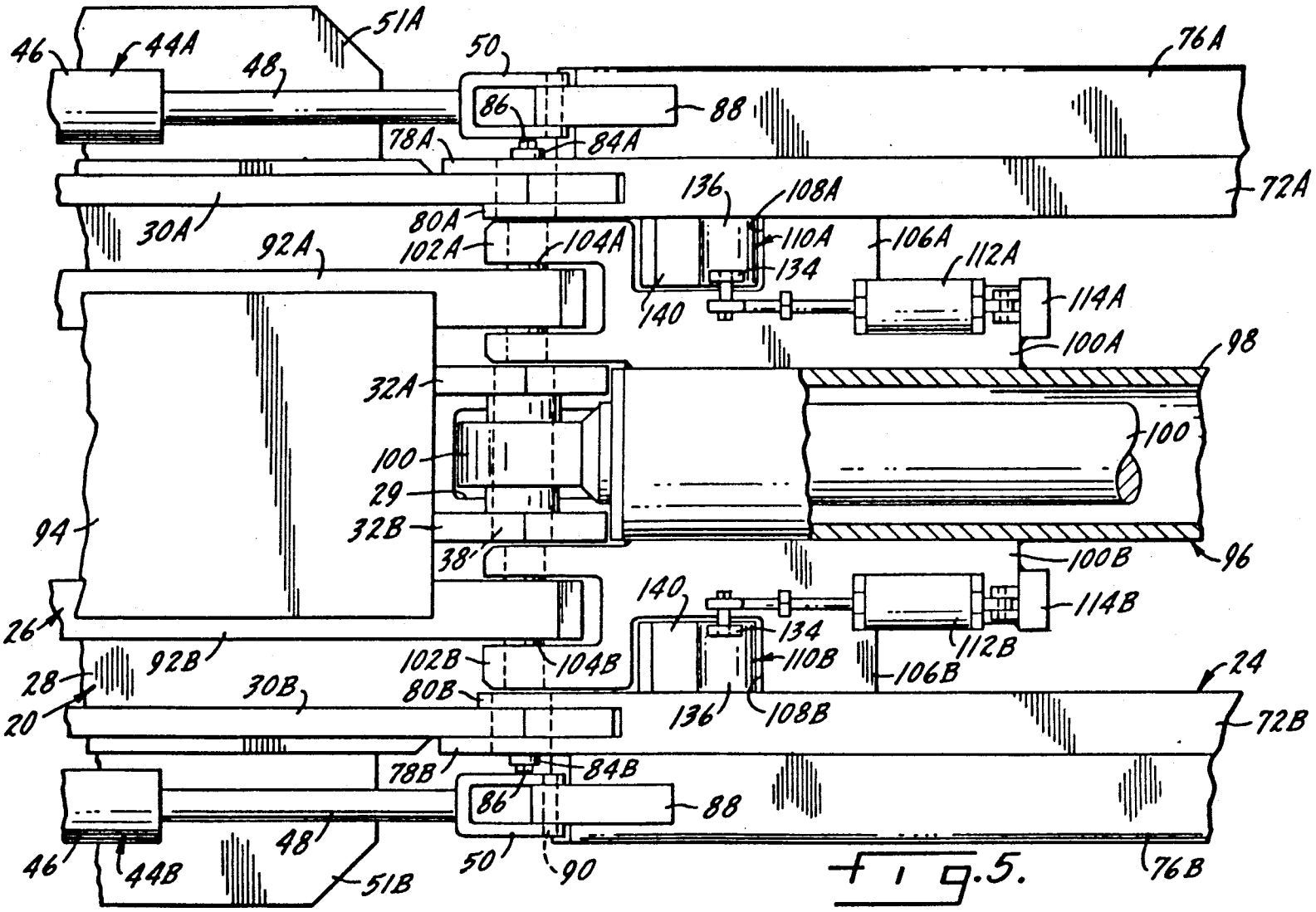
FIG. 5 is a plan view looking in the direction of line 5—5 of FIG. 2.

The central frame section further includes left and right outside rails 30A, 30B and left and right inside rails 32A, 32B. The rails are welded to the top surface of the base plate 28. The rails extend substantially throughout the length of the base plate. A cross piece 34 (FIG. 4)

extends between the upper ends of the inside rails 32. The ends of the inside rails 32 have aligned openings which receive pins 36 (FIG. 3) and 38 (FIG. 5). These pins attach the rods of hydraulic actuators which will be described in detail below.

Additional features of the frame central section 20 include left and right channels or pockets 40A and 40B welded to the outer surfaces of the outside rails 30A and 30B. As best seen in FIG. 2 the channels 40 are somewhat elongated, being about 40 inches long. The channels ar intended to receive the forks of a lift truck for maneuvering the jack into and out of its operating positions under a car.

Figures 2, 4, 6:
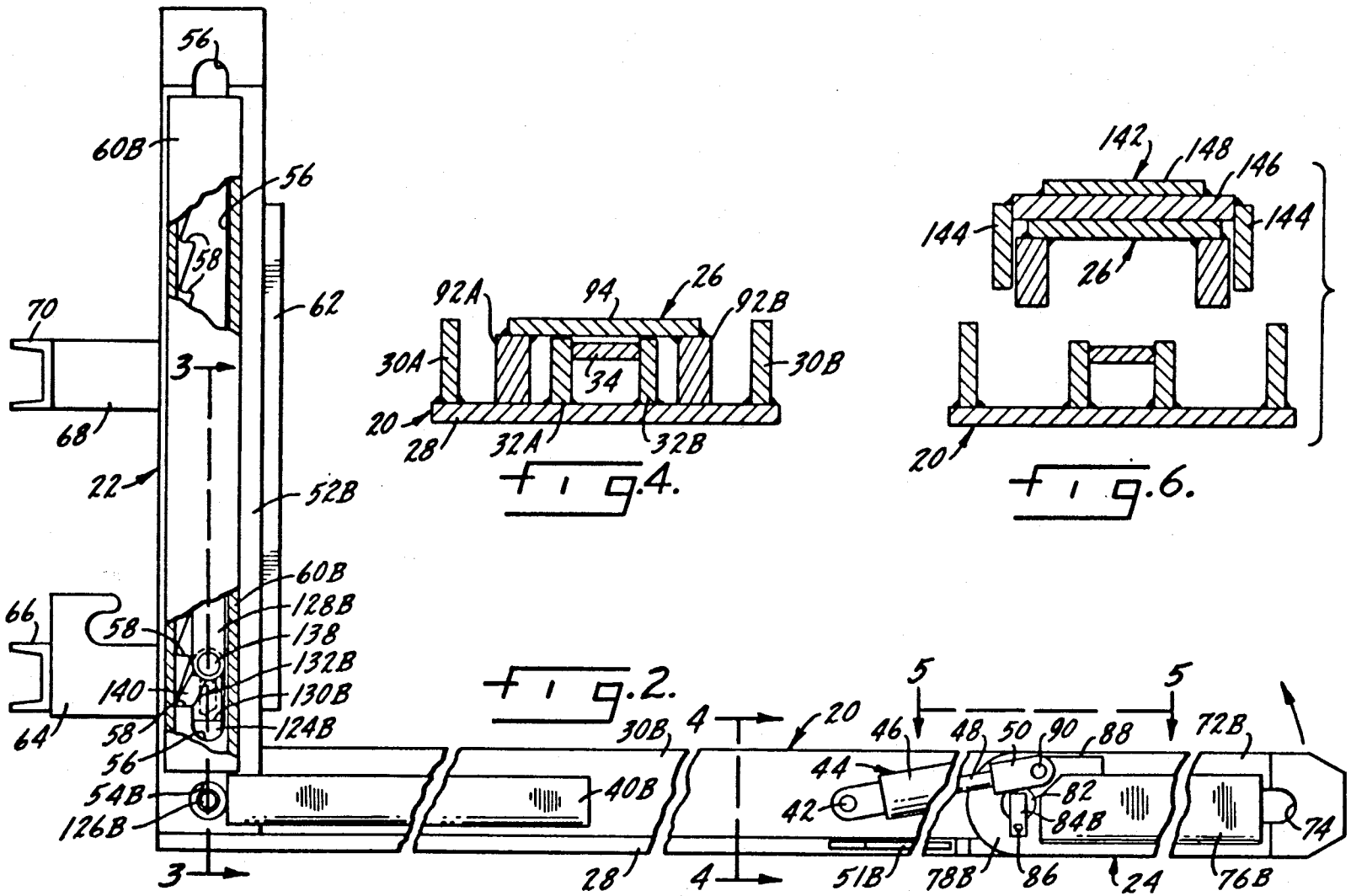
FIG. 2 is a side elevation view of the jack, with portions cut away.
FIG. 4 is a section taken along line 4—4 of FIG. 2.
FIG. 6 is a section similar to FIG. 4, showing an optional reinforcement for the lifting beam which allows the jack to be used on center beam type cars.

Near the pivot end of the frame the side rails 30 have openings which receive pins 42 (FIG. 2). The pins pivotally mount hydraulic actuators or pivot cylinders 44. While only one actuator is shown in the drawings, it will be understood that there is a left and right actuator attached to the left and right outside rails, respectively. Actuators 44 are preferably of the type having a cylinder 46 with an internal piston connected to a rod 48, which terminates at a shackle 50. A pair of left and right wings 51A, 51B are welded to the base plate 28 underneath the actuators 44. The wings help guide the jack into position when it is being inserted under a car. The wings also provide some protection for the actuators.

Figure 3:
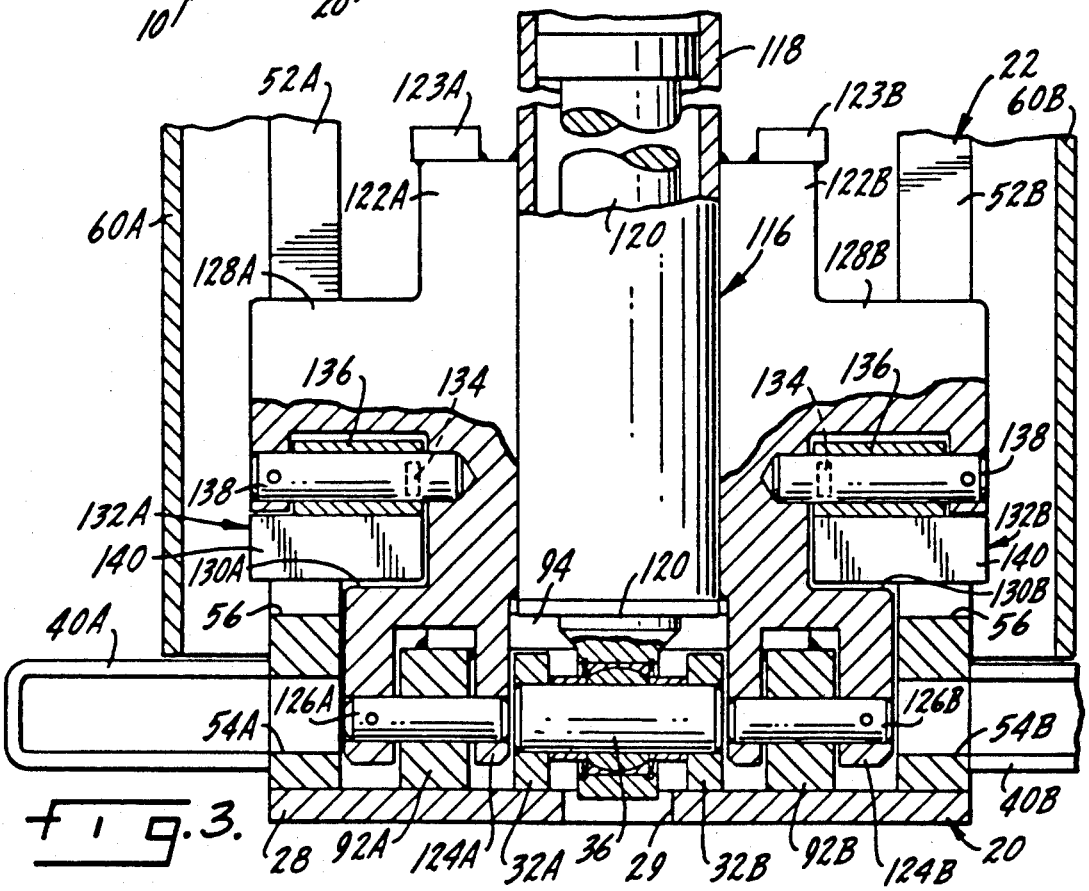
FIG. 3 is a section taken along line 3—3 of FIG. 2.

The fixed, upright section 22 of the frame is illustrated in FIGS. 2 and 3. The upright section includes left and right columns 52A, 52B welded to the base plate 28. The columns have access openings 54A, 54B near the bottoms thereof. Each column has a vertically-extending slot 56 cut therethrough. One vertical face of the slot is smooth and the other face has a plurality of teeth 58 which form a ratchet.

The outside or lateral surfaces of the columns have three-sided guards or shields 60A and 60B which prevent access to the slots 56. The columns also have a stiffening bar, one of which is shown at 62 in FIG. 2 mounted on the back side thereof. The front side of each column has a hook-shaped bracket 64. These brackets are connected by a transverse beam 66. The columns 52 also have additional brackets 68 which are connected by a cross beam 70. The beams 66 and 70 act as bumpers which protect the components mounted on the upright section 22 of the frame.

Details of the pivot section 24 of the frame are shown in FIGS. 2 and 5. The pivot section includes left and right columns 72A, 72B. These columns are similar to the columns 52 of the fixed section of the frame in that they each have the slot and ratchet construction of columns 52. The slot in column 72B is shown at 74 in FIG. 2. Columns 72 also have the channel shaped guards or shields 76A, 76B over the slots. The guards 76 each have a bracket, one of which is shown at 88 in FIGS. 2 and 5. Each bracket 88 is connected by a pin 90 to the shackle 50 of the associated pivot cylinder 44.

Columns 72 differ from columns 52 in their connection to the central section 20 of the frame. Instead of being welded to the base plate, columns 72 have forks formed at their lower edges which are pinned to the outer rails 30 of the central frame section 20. The forks have outer legs 78A, 78B and inner legs 80A and 80B. The legs are spaced to receive the rails 30, as seen in FIG. 5. The legs are held in position by pins, one of which is shown at 82 in FIG. 2. The pins extend through aligned openings in the forks and rails 30. The pins are retained by keepers 84A, 84B which are removably held in place by bolts 86.

Details of the lifting beam 26 are shown in FIGS. 3, 4 and 5. The lifting beam has left and right joists 92A, 92B. The joists are joined by an overlying plank 94 which is welded to the joists. As can be seen, the lifting beam 26 extends from one end of the central frame section to the other.

The lifting beam 26 is connected at its ends to first and second power lift means. The power lift means in a preferred embodiment comprises a pair of hydraulic actuators. A first hydraulic actuator is shown generally at 96 in FIG. 5. The first actuator has a cylinder 98 with an internal piston (not shown) and an extensible rod, the bottom portion of which is shown at 100. rod is pivotally connected to the central section of the frame about a first axis defined by the pin 38.

The actuator 96 further includes left and right lifting beam connectors 100A, 100B. The beam connectors 100 are welded to the cylinder 98. Yokes 102A, 102B are formed at the bottom of the connectors 100. The legs of the yokes define spaces which receive the joists 92A, 92B of the lifting beam 26. The joists are pivotally connected to the yokes about a second axis defined by pins 104A, 104B. The yokes 102 are arranged so that the pins 104 are coaxial. The pins extend through openings in the yokes and joists.

The lifting beam connectors 100 further include extension portions 106A, 106B. The extensions 106, together with the yokes 102, define cavities 108A, 108B in which pawls 110A, 110B are pivotally mounted. Details of the pawl construction will be shown below. The pawls are actuated by secondary hydraulic actuators 112A and 112B (FIG. 5). The actuators 112 have rods pivotally connected t the pawls and cylinders pivotally connected to mounting blocks 114A and 114B. The mounting blocks are welded to the tops of the connectors 100.

A second hydraulic actuator 116 (FIG. 3) is located at the fixed upright frame section 22. The actuator includes a cylinder 118 and an extensible rod 120. This actuator is essentially identical to the first actuator 96. Both actuators have a 30-inch stroke with a $4\frac{3}{4}$ inch diameter bore and a $3\frac{1}{2}$ inch diameter rod. They are rated at 3,000 psi.

The rod 120 is pivotably connected to pin 36. This fastens the rod to the inner rails 32 of the central frame section 20. As seen in FIGS. 3 and 5, the cutouts 29 in the base plate 20 provide clearance for the shackle portion of the rods 100 and 120.

Left and right lifting beams connectors 122A, 122B are welded to the cylinder 118. The tops of the beam connectors 122 carry cylinder mounting blocks 123A, 123B. Yokes 124A, 124B join the connectors 122 to the joists 92 by means of pins 126A, 126B. Access to the pins 126 is provided through openings 54 in the columns 52. Extensions 128A, 128B define cavities 130A, 130B in which pawls 132A, 132B are received.

Each of the pawls 110 and 132 has a similar construction. Each pawl has a lever 134 (see FIG. 5) welded to a hollow shaft 136. The shaft is retained in the cavity by a pin 138 (see FIG. 2). A dog 140 is welded to the shaft 136.

Although they are not shown in FIGS. 2 and 3, it will be understood that secondary actuating cylinders similar to the secondary cylinders 112 are provided for the pawls 132. The cylinders are connected between mounting blocks 123 and the levers 134 of the pawls 132. These cylinders, as the cylinders 112 in FIG. 5, are spring biased such that the dogs 140 of the pawls are biased toward the ratchet formed by teeth 58 in the respective columns of the frame. This is best seen in the cutaway portion of FIG. 2. When the secondary actuators are pressurized they move the dogs 140 to the position shown in dotted lines in FIG. 2, which allows the lifting beam to be lowered.

The pawls form a safety feature which prevents undesired lowering of the lifting beam. As can be seen from the shape of the teeth 58 in FIG. 2, when the beam is rising the dog 140 will slip past each tooth on the way up. In the event of a failure of one of the hydraulic actuators 96 and 116, or a failure of the hydraulic fluid supply system, the lifting beam will fall no further than the distance it takes to engage the closest of the teeth 58 with the dogs 140. The spring loading of the secondary cylinders provides a fail safe feature in that lowering of the beam can only take place when hydraulic fluid is supplied to the secondary cylinders which then move the pawls out of engagement with the ratchet teeth.

It will be understood that the jack has several additional features which are not shown in the drawings. For example, there is a hydraulic fluid supply pump and its associated engine which are preferably located on a separate frame or skid. The fluid pump is connected to appropriate control valves and the like mounted on the fixed, upright section 22 of the jack frame. These controls are not shown but may be conventional. Further, hydraulic fluid supply lines to the first and second hydraulic actuators 96 and 116, to the secondary actuators 112, and to the pivot cylinders 44 are also not shown. Lastly, a plate is used to connect the upper ends of the columns 72 on the pivot section of the frame. This plate is relatively thin so as to not unduly increase the silhouette or profile of the pivot section.

The use, operation and function of the invention are as follows:

A lifting operation begins with the pivot section 24 of the jack in its lowered, horizontal setup position, as shown in FIGS. 2 and 5. Preferably, a forklift truck is used to position the jack under a car by sliding the forks of the truck into the lifting pockets 40. The truck is then maneuvered from the side of a car to slide the jack's pivot section 24 and central sections 20 transversely under a car to be lifted. The profiles of the central and pivot sections are low enough to allow the jack to fit in the clearance between a well car and the rails.

Once under the car, the jack is lowered so that the bottom surface of the base plate 28 rests on the tops of the rails, with the base plate spanning the rails and the fixed section 22 standing adjacent one side of the car. With the jack in this position, the forklift is removed and the hydraulic power supply is connected to the jack. The operator then operates the controls to pressurize the pivot cylinders 44, thereby causing the pivot section 24 to rotate to its vertical, operating position. It can be seen that once this is done, the upright section and pivot section 24 are on opposite sides of the car frame.

At this point the operator can adjust the controls to supply hydraulic fluid to the lift cylinders 96 and 116. The cylinders 98 and 118 start to move upwardly carrying the lifting beam connectors 100 and 122 with them. This, in turn, causes the lifting beam to move up. As explained above, the pawls will simply slide past the ratchet teeth as the lifting beam is raised. As the lifting beam moves upwardly it will engage the bottom of the car frame and carry the frame with it as it continues to move up. Once the desired height of the car frame is reached, it is preferred to adjust the lifting cylinders so the dogs 140 are as close to fully engaged with a tooth as possible. This limits the amount of free fall in the event of a cylinder failure. The position of the dogs is visible to the operator on the inside surfaces of the columns. When the beam is raised, it will have the appearance of FIG. 1.

To lower the car, hydraulic fluid is supplied to the secondary cylinders to disengage the pawls from the ratchet teeth. The fluid supplied to the lifting cylinders is reversed and the lifting beam is slowly lowered. Once the lifting beam reaches it fully lowered position, the first and second axes defined by the pins 38 and 104 will coincide. At this point the pivot cylinders 44 can be actuated to rotate the pivot section 24 to a horizontal position. After disconnecting the hydraulic fluid supply, the forklift can then pick up the jack and move it away as needed.

It will be noted that the connection of the columns 72 to the rails 28 at pins 82 defines a third axis which coincides with the axis defined by pin 38. This arrangement permits pivoting of the pivot section about an axis defined by pins 82, 104 and 38, but only when these axes are aligned. That is, when the pivot section is in its vertical, operating position and the lifting beam is raised, pins 104 are out of alignment with pins 82 and 38. No pivoting motion can take place when the pins are not aligned. The raised lifting beam will prevent premature motion of the pivot section by virtue of the entrapment of the pawls 110 in the column slots 74.

Similarly extension of the hydraulic actuator 96 when the pivot section is not in its vertical position cannot occur because the lifting beam joists will prevent movement of the cylinder 98.

The jack of the present invention is also usable with center beam cars, with an additional reinforcing adapter shown generally at 142 shown in FIG. 6. The adapter has a pair of side plates 144 attached to a cover plate 146 on which a top plate 148 is welded. The adapter fits down over the lifting beam 26. A plurality of positioning lugs may be attached to the joists 92 to limit longitudinal motion of the adapter. The adapter transfers load out to the edges of the lifting beam t avoid bending it when used on center beam cars.

Whereas a preferred form of the invention has been shown and described, it will be understood that modifications may be made thereto without departing from the scope of the following claims.

We claim:

1. A jack for raising a railroad car above the car's normal position relative to the track rails, the jack comprising:

an elongated frame having a length sufficient to permit the frame to span the rails and rest on the tops thereof, the frame further comprising a central section which spans the rails and a pivot section pivotally connected to one end of the central section, the pivot section being moveable between a horizontal set up position, wherein the pivot section is parallel to the central section, and a vertical operating position;

a lifting beam mounted on the frame and extending transversely to the car frame beyond the sides thereof when the jack is in position underneath a car, the lifting beam being mounted for movement between a lowered position, wherein the beam is out of contact with the car frame, and a raised position, wherein the beam is in contact with the car frame and holds the car above the car's normal position relative to the track rails; and first and second power lift means mounted on the frame and connected to the lifting beam near opposite ends thereof, the power lift means being adapted to move the lifting beam between its lowered and raised positions;

the lifting beam, at least one of the power lift means and the central and pivot sections of the frame having a profile low enough, when lowered, to fit between the crowns of the rails and the underside of the car frame.

2. The jack of claim 1 wherein the frame further comprises a fixed, upright section connected to the other end of the central section.

3. The jack of claim 1 further comprising a ratchet and pawl mounted one on the pivot section of the frame and the other on a raisable portion of the lifting beam or power lift means, the ratchet and pawl being engageable to prevent undesired lowering of the lifting beam.

4. The jack of claim 2 further comprising a ratchet and pawl mounted one on the upright section of the frame and the other on a raisable portion of one of the lifting beam or power lift means, the ratchet and pawl being engageable to prevent undesired lowering of the lifting beam.

5. The jack of claim 4 further comprising a ratchet and pawl mounted one on the pivot section of the frame and the other on a raisable portion of one of the lifting beam or power lift means, the ratchet and pawl being engageable to prevent undesired lowering of the lifting beam.

6. The jack of claim 1 wherein the pivot section comprises first and second columns pivotally attached to the central section of the frame.

7. The jack of claim 6 wherein each column defines an elongated slot with a ratchet arranged along one side of the slot and a pawl mounted on a raisable portion of the lifting beam or power lift means, the ratchet and pawl being engageable to prevent undesired lowering of the lifting beam.

8. The jack of claim 2 wherein the upright section comprises first and second columns fixedly attached to the central section of the frame.

9. The jack of claim 8 wherein each column defines an elongated slot with a ratchet arranged along one side of the slot and a pawl mounted on a raisable portion of the lifting beam or power lift means, the ratchet and pawl being engageable to prevent undesired lowering of the lifting beam.

10. The jack of claim 1 wherein the power lift means are located beyond the sides of the car frame when the jack is in an operating position underneath a car.

11. A jack for raising a railroad car above the car's normal position relative to the track rails, the jack comprising:

an elongated frame having a central section of a length sufficient to permit the frame to span the rails and rest on the tops thereof;

a lifting beam mounted on the frame and extending transversely to the car frame beyond the sides thereof when the jack is in position underneath a car, the lifting beam being mounted for movement between a lowered position, wherein the beam is out of contact with the car frame, and a raised position, wherein the beam is in contact with the car frame and holds the car above the car's normal position relative to the track rails;

a first hydraulic actuator having a rod pivotally connected to the frame about a first axis at one end of the central section and a cylinder pivotally connected about a second axis to the lifting beam near one end thereof, the first and second axes coinciding when the lifting beam is in its fully lowered position such that the first hydraulic actuator is pivotable about said axes between a horizontal set up position and a vertical operating position;

a second hydraulic actuator having a rod connected to the central section of the frame and a cylinder connected to the lifting beam near the other end thereof, the first and second hydraulic actuators being adapted to move the lifting beam between its lowered and raised positions when the first actuator is in the vertical operating position

12. The jack of claim 11 wherein the frame further comprises a fixed, upright section connected to one end of the central section, and a pivot section pivotally connected to the other end of the central section about a third axis which coincides with the first axis.

13. The jack of claim 12 wherein the upright and pivot sections of the frame include safety means for supporting the lifting beam in the event of an actuator failure.

14. The jack of claim 13 wherein the safety means comprises at least one ratchet and pawl mounted one on a frame section and the other on a raisable portion of one of the lifting beam or cylinder, the ratchet and pawl being engageable to prevent undesired lowering of the lifting beam.

15. The jack of claim 11 wherein the lifting beam, the first hydraulic actuator and the central section of the frame having a profile low enough, when lowered, to fit between the crowns of the rails and the underside of the car frame.

16. The jack of claim 11 wherein the first and second hydraulic actuators are located beyond the sides of the car frame when the jack is in its operating position underneath a car.

17. A jack for raising a railroad well car above the car's normal position relative to the track rails, the jack comprising rail engaging means, a lifting beam having a length sufficient to permit engagement with the side sills of a well car when arranged generally transversely to the car frame, the rail engaging means and lifting beam being between the car frame and rails when the jack is in an operating position, and first and second power lift means disposed between the rail engaging means and the lifting beam, one of the power lift means being pivotally connected to both the rail engaging means and the lifting beam such that the power lift means is pivotable between a horizontal set up position and a vertical operating position, the power lift means being adapted to move the lifting beam between a lowered position, wherein the beam is out of contact with the car frame, and a raised position, wherein the beam is in contact with the car frame and holds the car above the car's normal position relative to the track rails.

18. The jack of claim 17 wherein said one of the power lift means comprises a hydraulic actuator having a rod pivotally connected to the rail engaging means about a first axis and a cylinder pivotally connected about a second axis to the lifting beam near one end thereof, the first and second axes coinciding when the lifting beam is in its fully lowered position such that the first hydraulic actuator is pivotable about said axes between a horizontal set up position and a vertical operating position.

* * * * *